US007624913B2

(12) United States Patent
Lutzig

(10) Patent No.: US 7,624,913 B2
(45) Date of Patent: Dec. 1, 2009

(54) HINGE-LID CONTAINER AND BLANK

(75) Inventor: Bodo-Werner Lutzig, Chavornay (CH)

(73) Assignee: Philip Morris USA Inc., Richmond, VA (US)

( * ) Notice: Subject to any disclaimer, the term of this patent is extended or adjusted under 35 U.S.C. 154(b) by 265 days.

(21) Appl. No.: 11/704,909

(22) Filed: Feb. 12, 2007

(65) Prior Publication Data

US 2007/0187472 A1 Aug. 16, 2007

(51) Int. Cl.
*B65D 43/16* (2006.01)
*B65D 85/10* (2006.01)

(52) U.S. Cl. ..... 229/146; 206/273; 229/160.1

(58) Field of Classification Search ..... 229/146, 229/160.1; 206/268, 273
See application file for complete search history.

(56) References Cited

U.S. PATENT DOCUMENTS

| | | | | | |
|---|---|---|---|---|---|
| 149,889 | A | * | 4/1874 | Smith | 229/160.1 |
| 2,929,542 | A | * | 3/1960 | O'Gorman | 206/268 |
| 3,944,066 | A | * | 3/1976 | Niepmann | 206/268 |
| 3,977,157 | A | * | 8/1976 | Davies et al. | 53/207 |
| 4,303,191 | A | * | 12/1981 | Foster et al. | 229/160.1 |
| 4,392,338 | A | | 7/1983 | Fox et al. | |
| 4,526,317 | A | * | 7/1985 | Cassidy | 229/146 |
| 4,729,508 | A | * | 3/1988 | Erdmann et al. | 229/146 |
| 5,957,280 | A | | 9/1999 | Focke et al. | |
| 6,138,823 | A | | 10/2000 | Focke et al. | |

(Continued)

FOREIGN PATENT DOCUMENTS

WO WO 2004 024596 A 3/2004

OTHER PUBLICATIONS

International Search Report and Written Opinion dated Feb. 19, 2008 for PCT/IB2007/001714.

(Continued)

*Primary Examiner*—Gary E Elkins
(74) *Attorney, Agent, or Firm*—Buchanan Ingersoll & Rooney PC

(57) ABSTRACT

An elongate laminar blank for forming a hinge-lid container has a box-defining portion and a lid-defining portion connected along a transverse hinge line. The lid-defining portion of the blank comprises: a lid rear wall panel extending from the transverse hinge line; a lid top wall panel connected to the lid rear wall panel along a first transverse fold line; a lid front wall panel connected to the lid top wall panel along a second transverse fold line and having an opposed outer transverse edge; a pair of opposed trapezoidal lid inner side wall panels connected to the lid rear wall panel on either side thereof along a first pair of longitudinal fold lines; and a pair of opposed trapezoidal lid outer side wall panels connected to the lid front wall panel on either side thereof along a second pair of longitudinal fold lines, each trapezoidal lid outer side wall panel having an angled outer edge. The outer transverse edge of the lid front wall panel, the second pair of longitudinal fold lines and respective angled outer edges of the trapezoidal lid outer side wall panels converge at either end of the outer transverse edge and in that the length of the trapezoidal lid outer side wall panels in the longitudinal direction of the blank is greater than the length of the trapezoidal lid inner side wall panels.

17 Claims, 2 Drawing Sheets

U.S. PATENT DOCUMENTS

| | | | | |
|---|---|---|---|---|
| 6,742,651 | B1 * | 6/2004 | Focke et al. | 206/268 |
| 2006/0021883 | A1 | 2/2006 | Focke et al. | |

OTHER PUBLICATIONS

European Search Report issued in corresponding EP Application No. 06250758.7-2308.

International Preliminary Report on Patentability dated Aug. 19, 2008 for PCT/IB2007/001714.

Partial International Search Report dated Nov. 19, 2007 for PCT/IB2007/001714.

* cited by examiner

HINGE-LID CONTAINER AND BLANK

CROSS-REFERENCE TO RELATED APPLICATION

This application claims priority under 35 U.S.C. §119 to European Application No. 06250758.7, filed Feb. 13, 2006, the entire content of which is hereby incorporated by reference.

The present invention relates to a novel hinge-lid container and in particular to a novel hinge-lid pack or carton for elongate smoking articles such as cigarettes.

Cigarettes are commonly sold in rigid cuboid packs having a box portion and a lid portion, which is hinged to the rear wall of the box portion. These hinge-lid cigarette packs are typically formed from elongate laminar cardboard blanks that include various panels and flaps, which when folded about appropriate score lines form the box portion and the lid portion of the pack.

Elongate laminar cardboard blanks for forming cuboid hinge-lid cigarette packs conventionally comprise a rectangular lid front wall panel, a rectangular lid top wall panel and a rectangular lid rear wall panel that form the front wall, top wall and rear wall, respectively, of the lid portion of the hinge-lid pack. The lid front wall panel, lid top wall panel and lid rear wall panel are separated from one another in the longitudinal direction of the blank by a pair of transverse score lines, along which the laminar blank is folded during production of the pack. The term score line is used to indicate a line formed by, for example, creasing, scoring, perforating, embossing or otherwise compressing, cutting and/or weakening the blanks.

To form the opposed side walls of the lid portion of the hinge-lid pack, the elongate laminar blank typically further comprises a pair of trapezoidal lid inner side wall panels, which are connected to either side of the lid rear wall panel along a first pair of longitudinal score lines, and a pair of trapezoidal lid outer side wall panels of the same size and shape as the lid inner side wall panels. These lid outer and inner side wall panels are connected to either side of the lid front wall panel along a second pair of longitudinal score lines that are collinear with the first pair of longitudinal score lines.

During folding of the blank to produce a pack, the lid outer side wall panels are affixed to the outer surfaces of the corresponding lid inner side wall panels. For the reasons discussed below, it is desirable for the lid outer side wall panels of the hinge-lid pack to be properly aligned with the lid inner side wall panels, so that the angled free edges thereof, which form the lower edges of the side walls of the lid portion, directly overlie one another. However, due to the complexity of the folding process and the very high speed of production, which may be up to 1000 packs per minute, this is not always achievable resulting in a concomitant spacing between the angled free edges. This spacing is sometimes referred to in the art as a miter misalignment.

In hinge-lid cigarette packs exhibiting such a miter misalignment, the lid inner side wall panels of the folded elongate laminar blank protrude slightly from beneath the lid outer side wall panels at the base of the lid portion of the formed pack. As the angled free edges of the protruding lid inner side wall panels contact the angled upper edges of the side walls of the box portion of the hinge-lid pack, the projection of the lid inner side wall panels from beneath the lid outer side wall panels creates a gap on either side of the hinge-lid pack between the angled free edge of each lid outer side wall panel and the angled free edge of the corresponding side wall of the box portion when the pack is closed. To reduce the visibility of this gap, the colour of the outer surface of the lid inner side wall panels is typically the same as that of the outer surface of the lid outer side wall panels. However, because the angled free edges of the lid outer side wall panels are spaced apart from the angled upper edges of the side walls of the box portion of the hinge-lid pack when the pack is closed, the lower edge of the front wall of the lid portion is automatically also spaced apart from the upper edge of the front wall of the box portion of the pack in the closed position. This exposes a portion of the inner frame or inner liner in which the cigarettes are wrapped. As the inner frame and inner liner are commonly not the same colour as the front walls of the lid portion and body portion of the pack it is preferable for this spacing to be as invisible as possible.

Elongate laminar cardboard blanks often also include a rectangular lid front wall flap that extends from the lid front wall panel. During erection of the pack, this lid front wall flap is folded through 180 degrees about a further transverse score line, which separates it from the lid front wall panel, and affixed to the inner surface of the lid front wall panel. In the formed hinge-lid pack, the lid front wall flap thereby rests against the inside of the front wall of the lid portion of the pack. As well as providing reinforcement to the lid portion of the formed hinge-lid pack, the lid front wall flap may be advantageously provided with retention means that help to retain the lid portion thereof in a completely closed position.

The scoring lines about which the various panels and flaps of the elongate laminar blank are folded during erection of the hinge-lid pack are deformations in the cardboard or other material forming the blank that have a defined width, typically of between 1.0 mm and 1.5 mm. The exact positions of the bends or folds produced by folding the elongate laminar blank about the scoring lines are, however, undefined within this width. Consequently, more or less material may remain on one side of a fold than on the other side thereof.

Taking this uncertainty in the exact position of each fold into account, to ensure that the lateral edges of the lid front wall flap do not interfere with the longitudinal scoring lines separating the lid outer side wall panels from the lid front wall panel during folding, the lid front wall flap is of reduced width compared to the lid front wall panels thereof. To facilitate the stamping or die cutting of such blanks, the angled free edges of the lid outer side wall panels, which form the lower edges of the side walls of the lid portion of hinge-lid packs formed there from, terminate at opposite ends of the transverse scoring line separating the reduced width lid front wall flap from the lid front wall panel. Part of such a prior art elongate laminar blank for forming a hinge-lid cigarette pack is shown in FIG. 1 and described further below.

It would be desirable to provide a hinge-lid container, in particular a hinge-lid pack for cigarettes, that does not exhibit a miter misalignment. It would be particularly desirable to provide a hinge-lid container that does not exhibit a miter misalignment, which may be produced using existing machinery for the assembly of hinge-lid containers, preferably at the same high speed of production. It would further be desirable to provide such a hinge-lid container formed from an elongate laminar blank that may be produced with a minimum of change to known machinery for producing conventional elongate laminar blanks.

According to the present invention there is provided an elongate laminar blank for forming a hinge-lid container having a box-defining portion and a lid-defining portion connected along a transverse hinge line, the lid-defining portion comprising: a lid rear wall panel extending from the transverse hinge line; a lid top wall panel connected to the lid rear wall panel along a first transverse fold line; a lid front wall panel connected to the lid top wall panel along a second transverse fold line and having an opposed outer transverse edge; a pair of opposed trapezoidal lid inner side wall panels connected to the lid rear wall panel on either side thereof along a first pair of longitudinal fold lines; and a pair of opposed trapezoidal lid outer side wall panels connected to the lid front wall panel on either side thereof along a second pair of longitudinal fold lines, each trapezoidal lid outer side wall panel having an angled outer edge, characterised in that the outer transverse edge of the lid front wall panel, the second pair of longitudinal fold lines and respective angled outer edges of the trapezoidal lid outer side wall panels converge at either end of the outer transverse edge and in that the length of the trapezoidal lid outer side wall panels in the longitudinal direction of the blank is greater than the length of the trapezoidal lid inner side wall panels.

Through convergence of the outer transverse edge of the lid front wall panel, second pair of longitudinal fold lines and respective angled outer edges of the trapezoidal lid outer side wall panels at either end of the outer transverse edge, the length of the lid outer side wall panels of the elongate laminar blank according to the invention are advantageously increased compared to the length of the lid outer side wall panels of conventional prior art elongate laminar blanks for forming hinge-lid container of the same dimensions.

As the trapezoidal lid outer side wall panels of elongate laminar blanks according to the invention are consequently longer than the trapezoidal lid inner side wall panels thereof, when elongate laminar blanks according to the invention are folded to form a hinge-lid container the lid inner side wall panels are advantageously still completely covered by the lid outer side wall panels even when the lid outer side wall panels and lid inner side wall panels are not perfectly aligned.

The trapezoidal lid outer side wall panels of elongate laminar blanks for forming hinge-lid cigarette packs according to the invention may be between about 0.1 mm and about 1.5 mm greater in length than the trapezoidal lid inner side wall panels thereof. In preferred embodiments, the trapezoidal lid outer side wall panels are between about 0.1 mm and about 1.0 mm, more preferably between about 0.1 mm and 0.7 mm, greater in length than the trapezoidal lid inner side wall panels.

Preferably, the elongate laminar blank of the invention further comprises a lid front wall flap connected to the lid front wall panel along a transverse fold line forming the transverse outer edge of the lid front wall panel.

Preferably, the outer transverse edge of the lid front wall panel, the second pair of longitudinal fold lines, respective angled outer edges of the trapezoidal lid outer side wall panels and respective opposed side edges of the lid front wall flap converge at either end of the outer transverse edge.

The lid front wall flap may, for example, be rectangular in shape and of substantially the same width, in the transverse direction of the blank, as the lid front wall panel. In this case, the side edges of the lid front wall flap are substantially collinear extensions of the second longitudinal fold lines connecting the lid outer side wall panels to the lid front wall panel.

Alternatively, the lid front wall panel may be non-rectangular in shape with a width that decreases between the transverse fold line forming the outer edge of the lid front wall panel and an opposed transverse edge of the lid front wall flap. For example, the lid front wall flap may have inwardly curved or angled side edges. In a particularly preferred embodiment of the invention, the lid front wall flap is trapezoidal in shape.

The decrease in width of the lid front wall flap advantageously ensures that the lid front wall flap does not interfere with folding of the lid outer side wall panels about the second pair of longitudinal score lines. As a result, the lid-defining portion of the elongate laminar blank may be advantageously folded more tightly around, for example, a wrapped bundle of cigarettes in order to produce a hinge-lid cigarette pack, which enables the precision of the folds of the lid-defining portion of the blank to be improved, thus additionally reducing any miter misalignment.

According to the invention there is also provided a hinge-lid container, and in particular a hinge-lid pack of cigarettes, formed from a folded elongate laminar blank according to the invention.

Conventional elongate laminar blanks for forming hinge-lid cigarette packs are cut out from sheets of cardboard or other material using die cutters with knives having a central cutting edge. Knives with central cutting edges are employed rather than knives with side cutting edges as the latter wear out more rapidly and so must be replaced more often. Nevertheless, by exchanging the knives with central cutting edges used to cut out the angled outer edges of the trapezoidal lid outer side wall panels of conventional elongate laminar blanks with side edge knives, without changing the location of the knives themselves, elongate laminar blanks for forming hinge-lid cigarette packs according to the present invention may be produced using existing die cutters. As the knives of the die cutter have a certain thickness, this simple exchange moves the cutting edge of the knives from a central position to a side position by about 0.1 mm to about 0.5 mm, thereby lengthening the trapezoidal lid outer side wall panels by the desired amount. Elongate laminar blanks according to the invention may, thereby, advantageously be produced using existing die cutters without the need to reconstruct the entire die cut form, thus making the required changes to the die cutter considerably easier and cheaper.

According to the invention there is further provided a method of producing an elongate laminar blank according to the invention comprising the step of modifying a die cutter by exchanging knives with central cutting edges that, in use, cut out angled outer edges of a pair of opposed trapezoidal lid outer side wall panels forming part of a lid-defining portion of the elongate laminar blank with knives with side cuttings edges.

The invention will be further described, by way of example only, with reference to the accompanying drawings in which.

Figure 1:
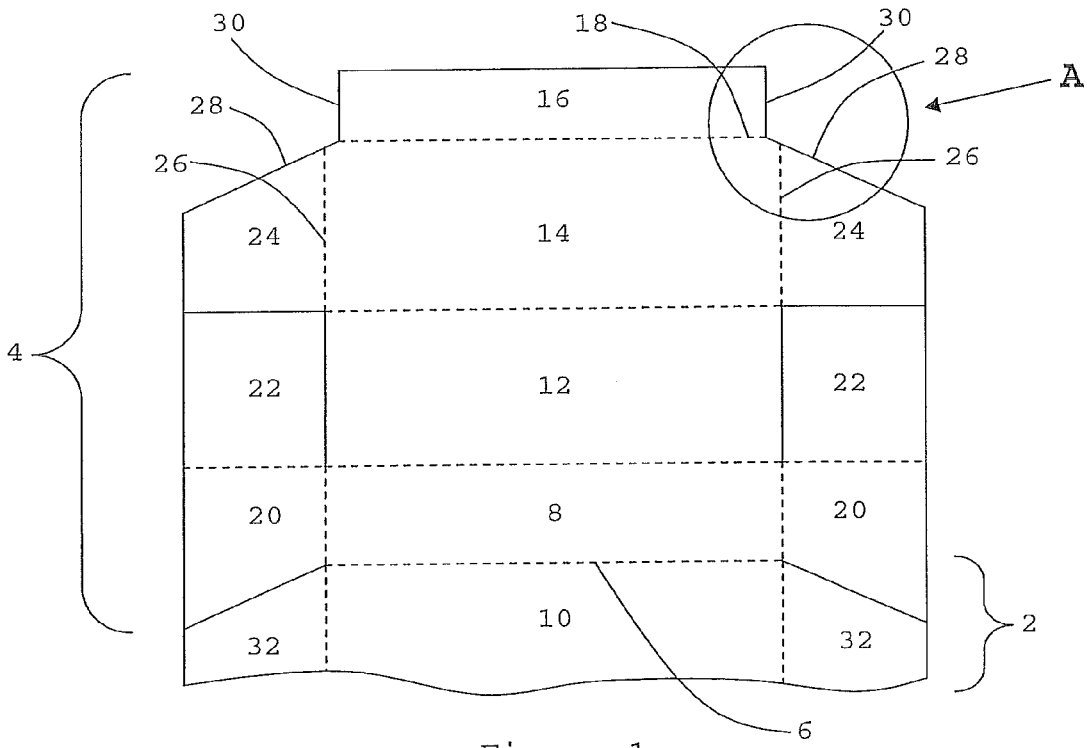
Figure 1 Prior Art
FIG. 1 shows a plan view of part of a prior art laminar blank for forming a hinge-lid cigarette pack.

FIG. 1 shows part of a known elongate laminar blank for forming a cuboid hinge-lid cigarette pack. The elongate blank includes a box-defining portion 2 (only part of which is shown in FIG. 1) and a lid-defining portion 4, which are separated from one another by a transverse hinge line 6 (shown by a broken line in FIG. 1).

In the longitudinal direction of the elongate laminar blank, the box-defining portion 2 and lid-defining portion 4 each comprise a respective plurality of rectangular panels having substantially the same width in the transverse direction of the blank, which are foldably connected to each other along transverse score lines parallel to the hinge line 6. As shown in FIG. 1, the lid-defining portion 4 comprises a rectangular lid rear wall panel 8, which is connected along the transverse hinge line 6 to a rectangular box rear wall panel 10 of the box-defining portion 2 of the blank, a rectangular lid top wall panel 12 connected to the lid rear wall panel 8, a rectangular lid front wall panel 14 connected to the lid top wall panel 12. The lid portion 4 also comprises a rectangular lid front wall flap 16 connected to the lid front wall panel 14 along a transverse score line 18, which is of reduced width in the transverse direction of the blank compared to the lid front wall panel 14.

The lid-defining portion 4 of the elongate blank further comprises a pair of opposed trapezoidal lid inner side wall panels 20, which are foldably connected to the side edges of the lid rear wall panel 8 along longitudinal score lines, perpendicular to the transverse hinge line 6. As shown in FIG. 1, each lid inner side wall panel 20 has an upper edge parallel to the hinge line 6, defined by a transverse score line that is a substantially collinear extension of the transverse score line connecting the lid rear wall panel 8 to the lid top wall panel 12. The lower edge of each lid inner side wall panel 20 is defined by an angled cut. A pair of opposed lid side wall flaps 22 of substantially the same width in the transverse direction of the blank as the lid inner side wall panels 20 and substantially the same length in the longitudinal direction of the blank as the lid top wall panel 12, are pivotably attached to the upper edges of the lid inner side wall panels 20.

A pair of opposed trapezoidal lid outer side wall panels 24 of substantially the same size and shape as the lid inner side wall panels 20 are foldably connected to the side edges of the lid front wall panel 14 along respective longitudinal score lines 26, perpendicular to the transverse hinge line 6. Each lid outer side wall panel 24 has a lower edge parallel to the hinge line 6, defined by a transverse cut which is a substantially collinear extension of the transverse score line connecting the lid top wall panel 12 to the lid front wall panel 14, and an angled upper edge 28.

With reference to the encircled region of the elongate laminar blank labelled A in FIG. 1, the angled upper edges 28 extend beyond the longitudinal score lines 26 and terminate at either end of the transverse scoring line 18, at the points where the longitudinal side edges 30 of the lid front wall flap 16 meet the transverse scoring line 18.

In addition to the box rear wall panel 10, the box-defining portion 2 of the prior art elongate laminar blank further comprises, in the longitudinal direction of the blank, a box bottom wall panel connected to the box rear wall panel and a box front wall panel connected to the box bottom wall panel, which are not shown in FIG. 1. A pair of opposed trapezoidal box inner side wall panels 32 and a pair of opposed trapezoidal box outer side wall panels (not shown) of substantially the same size and shape are foldably connected to the side edges of the box rear wall panel 10 and box front wall panel, respectively, along longitudinal score lines perpendicular to the transverse hinge line 6. A pair of opposed box side wall flaps are pivotably attached to the lower edges of the box inner side wall panels.

Figure 2:
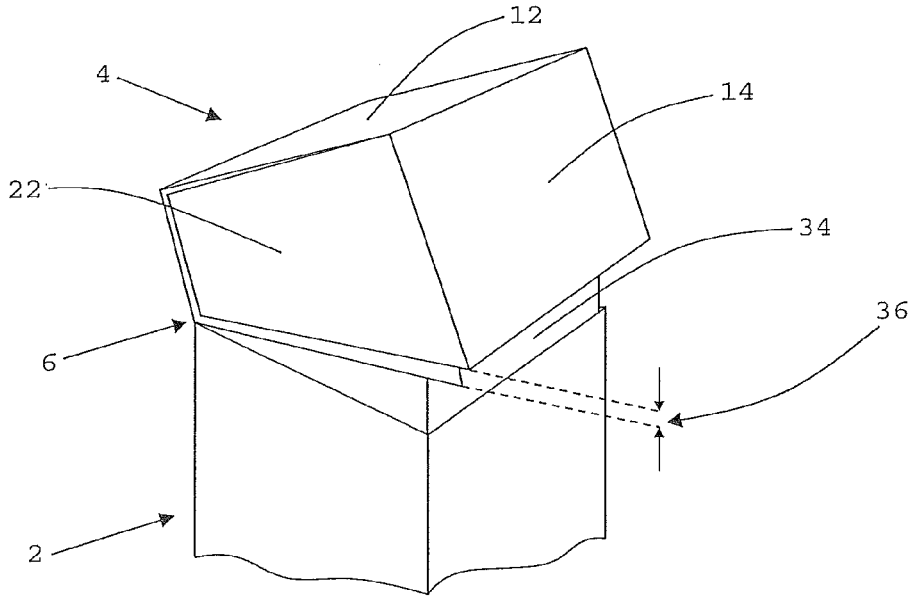
Figure 2 Prior Art
FIG. 2 shows a schematic front perspective view of the lid portion of a hinge-lid pack formed from the blank shown in FIG. 1.

FIG. 2 shows the lid portion 4 and an upper part of the box portion 2 of a cuboid hinge-lid pack formed by folding the various panels and flaps of the elongate laminar blank of FIG. 1 in a conventional manner; corresponding reference numbers are used in FIG. 2 for parts of the cuboid hinge-lid cigarette pack that are similar to parts of the elongate laminar blank of FIG. 1 already described. The hinge-lid pack further comprises an inner frame 34 mounted in the box portion 2 thereof, which extends upwardly from the box portion 2 into space covered by the lid portion 4 in a closed position.

As shown in FIG. 2, in the formed hinge-lid pack the lid outer side wall panels 24 of the elongate laminar blank do not completely cover the lid inner side wall panels 20, to which they are affixed. In particular, the angled upper edges 28 of the lid outer side wall panels 24 are not aligned with the angled lower edges of the lid inner side wall panels 20 and the hinge-lid pack exhibits a miter misalignment as indicated by the pair of arrows with the reference numeral 36 in FIG. 2.

Figure 3:
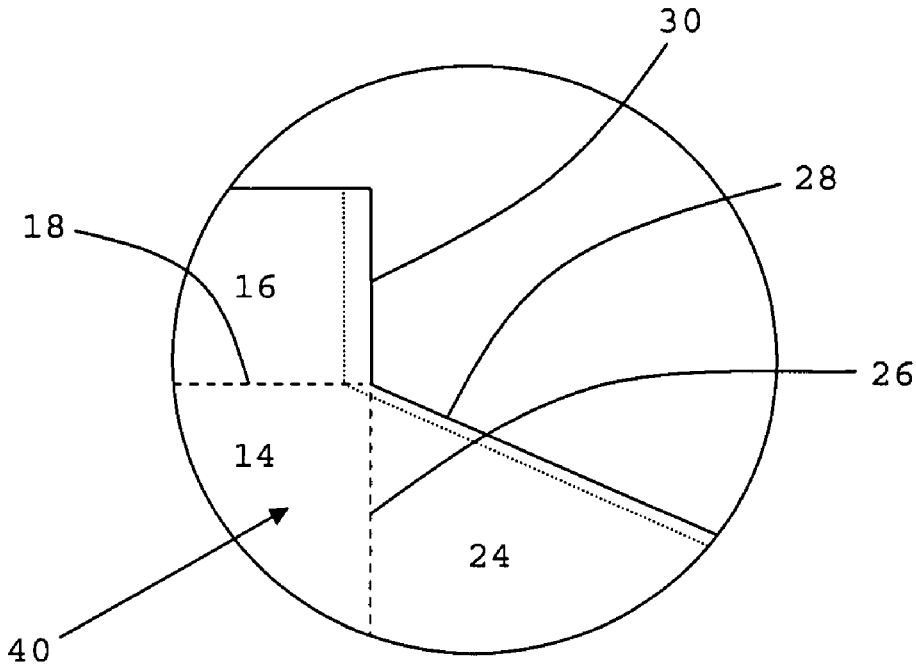
FIG. 3 shows a plan view of part of a laminar blank for forming a hinge-lid container according to a first embodiment of the invention.

An elongate laminar blank 40 for forming a hinge-lid container according to a first embodiment of the present invention is shown in FIG. 3; the same reference numbers are used in FIG. 3 for parts of the elongate laminar blank 40 that are the same or similar to parts of the prior art elongate laminar blank shown in FIG. 1 and described above. FIG. 3 shows only the region of the laminar elongate blank 40 corresponding to the encircled region of the prior art elongate laminar blank labelled A in FIG. 1; the remainder of the elongate laminar blank 40 according to the first embodiment of the invention may be of any suitable known construction.

As shown in FIG. 3, the lid front wall flap 16 of the elongate laminar blank 40 according to the first embodiment of the invention is of substantially the same width in the transverse direction of the blank as the lid front wall panel 14 thereof, so that the longitudinal side edges 30 of the lid front wall flap 16 are substantially collinear extensions of the longitudinal score lines 26 connecting the lid outer side wall panels 24 to the lid front wall panel 14.

The angled upper edges 28 of the lid outer side wall panels 24 of the blank 40 terminate at either end of the transverse scoring line 18 connecting the lid front wall flap 16 to lid front wall panel 14, at the points where the longitudinal side edges 30 of the lid front wall flap 16 meet the transverse scoring line 18. The angled upper edges 28, the longitudinal side edges 30, the longitudinal score lines 26 and the transverse score line 18 thereby all converge at the respective opposed ends of the transverse score line 18. By "converge" it is meant that, allowing for the width or thickness of the longitudinal scoring lines 16 and transverse scoring line 18, the various cuts, edges and score lines meet at a substantially common point. Within this meaning, the cuts, edges and score lines are still considered to converge where the angled upper edges 28 or the longitudinal side edges 30 are displaced relative to the longitudinal scoring lines 16 or transverse scoring line 18 by an amount less than or equal to the thickness of the scoring lines.

For the purposes of comparison, the angled upper edges 28 of the prior art elongate laminar blank shown in FIG. 1 are shown by dotted lines in FIG. 3, together with the longitudinal side edges 30 thereof. The outward displacement of the angled upper edges 28 and the longitudinal side edges 30 of the elongate laminar blank 40 according to the first embodiment of the invention relative to those of the prior art elongate laminar blank, increases the length or height of the lid outer side wall panels 24 thereof without altering the dimensions of any other panels or flaps of the blank 40 other than the width of the lid front wall flap 16. As a result, the lid outer side wall panels 24 of the elongate laminar blank 40 according to the first embodiment of the invention are longer than the lid inner side wall panels thereof.

When the elongate laminar blank 40 according to the first embodiment of the invention is folded to form a hinge-lid container, the increased length of the lid outer side wall panels 24 compared to the lid inner side wall panels advantageously results in the lid inner side wall panels being completely covered by the lid outer side wall panels 24 even when the lid outer side wall panels 24 and lid inner side wall panels are not properly aligned.

Figure 4:
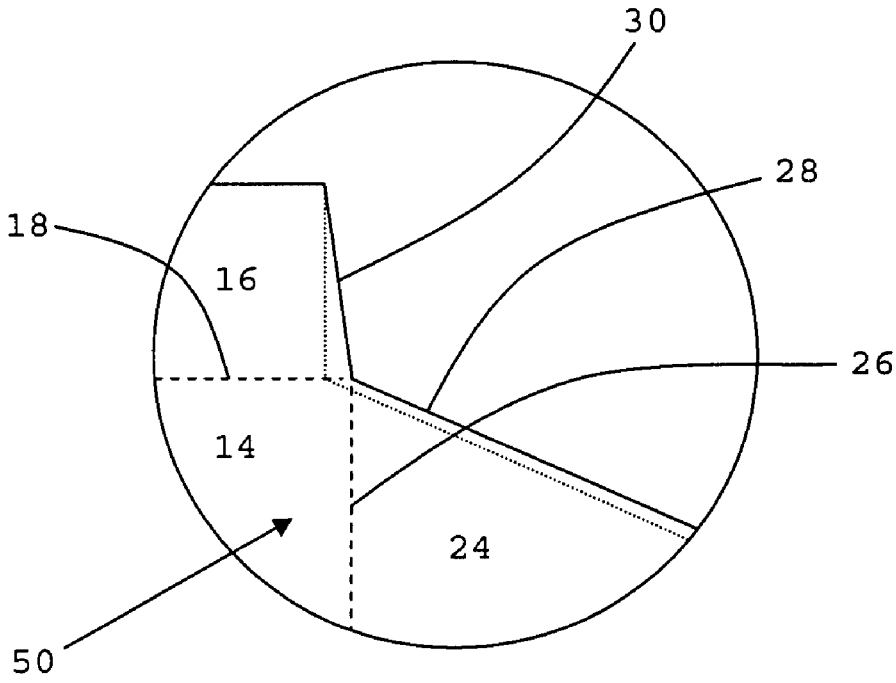
FIG. 4 shows a plan view of part of a laminar blank for forming a hinge-lid container according to a second embodiment of the invention.

FIG. 4 shows part of an elongate laminar blank 50 for forming a hinge-lid container according to a second embodiment of the invention. The elongate laminar blank 50 is of largely similar construction to the elongate laminar blank according to the first embodiment of the invention shown in FIG. 3.

However, while the angled upper edges 28, the longitudinal side edges 30, the longitudinal score lines 26 and the transverse score line 18 of the elongate laminar blank 50 according to the second embodiment of the invention all converge at the respective opposed ends of the transverse score line 18, the side edges 28 of the lid front wall flap 16 thereof are not collinear extensions of the longitudinal score lines 26.

Instead, the side edges 28 of the lid front wall flap 16, which is trapezoidal in shape, are disposed at an acute angle relative to the longitudinal score lines 26. The width of the lid front wall flap 16 in the transverse direction of the blank 50 thereby gradually decreases between the transverse score line 18 and the opposed transverse edge of the lid front wall flap 16. This decrease in width advantageously ensures that the lid front wall flap 16 does not interfere with folding of the lid outer side wall panels 24 about the longitudinal score lines 26 during erection of a hinge-lid container from the elongate laminar blank 50 according to the second embodiment of the invention. As a result, the lid-defining portion of the elongate laminar blank 50 may be folded more tightly around a wrapped bundle of cigarettes to produce the hinge-lid cigarette pack. This enables the precision of the folds of the lid-defining portion of the blank 50 that can cause miter misalignment to be advantageously improved and so any miter misalignment to be reduced.

The invention claimed is:

1. An elongate laminar blank for forming a hinge-lid container having a box-defining portion and a lid-defining portion connected along a transverse hinge line, the lid-defining portion comprising:

a lid rear wall panel extending from the transverse hinge line;

a lid top wall panel connected to the lid rear wall panel along a first transverse fold line;

a lid front wall panel connected to the lid top wall panel along a second transverse fold line and having an opposed outer transverse edge;

a pair of opposed trapezoidal lid inner side wall panels connected to the lid rear wall panel on either side thereof along a first pair of longitudinal fold lines; and a pair of opposed trapezoidal lid outer side wall panels connected to the lid front wall panel on either side thereof along a second pair of longitudinal fold lines, each trapezoidal lid outer side wall panel having an angled outer edge, characterised in that the outer transverse edge of the lid front wall panel, the second pair of longitudinal fold lines and respective angled outer edges of the trapezoidal lid outer side wall panels converge at either end of the outer transverse edge and in that the length of the trapezoidal lid outer side wall panels in the longitudinal direction of the blank is greater than the length of the trapezoidal lid inner side wall panels by approximately 0.1 mm to 1.5 mm.

2. An elongate laminar blank according to claim 1 wherein the lid-defining portion further comprises a lid front wall flap connected to the lid front wall panel along a transverse fold line forming the transverse outer edge of the lid front wall panel.

3. An elongate laminar blank according to claim 2 wherein the outer transverse edge of the lid front wall panel, second pair of longitudinal fold lines, respective angled outer edges of the trapezoidal lid outer side wall panel and respective opposed side edges of the lid front wall flap converge at either end of the outer transverse edge.

4. An elongate laminar blank according to claim 3 wherein the opposed side edges of the lid front wall flap are substantially collinear extensions of the second pair of longitudinal fold lines.

5. An elongate laminar blank according to claim 2 wherein the width of the lid front wall flap in the transverse direction of the blank decreases between the transverse fold line forming the outer edge of the lid front wall panel and an opposed transverse edge of the lid front wall flap.

6. An elongate laminar blank according to claim 2 wherein the lid front wall flap is trapezoidal in shape.

7. A hinge-lid container formed from a folded elongate laminar blank according to claim 1.

8. A hinge-lid pack of cigarettes formed by folding an elongate laminar blank according to claim 1 around a bundle of cigarettes.

9. An elongate laminar blank according to claim 1, wherein the length of the trapezoidal lid outer side wall panels in the longitudinal direction of the blank is greater than the length of the trapezoidal lid inner side wall panels by approximately 0.1 mm to 1.0 mm.

10. An elongate laminar blank according to claim 1, wherein the length of the trapezoidal lid outer side wall panels in the longitudinal direction of the blank is greater than the length of the trapezoidal lid inner side wall panels by approximately 0.1 mm to 0.7 mm.

11. An elongate laminar blank according to claim 1, wherein during assembly of the hinge-lid container, the increased length of the lid outer side wall panels as compared to the lid inner side wall panels results in the lid inner side wall panels being completely covered by the lid outer side wall panels when the lid outer side wall panels and lid inner side wall panels are not properly aligned.

12. An elongate laminar blank for forming a hinge-lid container having a box-defining portion and a lid-defining portion connected along a transverse hinge line, the lid-defining portion comprising:

a lid rear wall panel extending from the transverse hinge line;

a lid top wall panel connected to the lid rear wall panel along a first transverse fold line;

a lid front wall panel connected to the lid top wall panel along a second transverse fold line and having an opposed outer transverse edge;

a pair of opposed trapezoidal lid inner side wall panels connected to the lid rear wall panel on either side thereof along a first pair of longitudinal fold lines; and a pair of opposed trapezoidal lid outer side wall panels connected to the lid front wall panel on either side thereof along a second pair of longitudinal fold lines, each trapezoidal lid outer side wall panel having an angled outer edge, characterised in that the length of the trapezoidal lid outer side wall panels in the longitudinal direction of the blank is greater than the length of the trapezoidal lid inner side wall panels by approximately 0.1 mm to 1.5 mm.

13. An elongate laminar blank according to claim 12, wherein the length of the trapezoidal lid outer side wall panels in the longitudinal direction of the blank is greater than the length of the trapezoidal lid inner side wall panels by approximately 0.1 mm to 1.0 mm.

14. An elongate laminar blank according to claim 12, wherein the length of the trapezoidal lid outer side wall panels in the longitudinal direction of the blank is greater than the length of the trapezoidal lid inner side wall panels by approximately 0.1 mm to 0.7 mm.

15. An elongate laminar blank according to claim 12 wherein the lid-defining portion further comprises a lid front wall flap connected to the lid front wall panel along a transverse fold line forming the transverse outer edge of the lid front wall panel.

16. An elongate laminar blank according to claim 15 wherein the lid front wall flap is trapezoidal in shape.

17. An elongate laminar blank according to claim 12, wherein during assembly of the hinge-lid container, the increased length of the lid outer side wall panels as compared to the lid inner side wall panels results in the lid inner side wall panels being completely covered by the lid outer side wall panels when the lid outer side wall panels and lid inner side wall panels are not properly aligned.

* * * * *